US007357901B2

(12) United States Patent
Nakatani

(10) Patent No.: US 7,357,901 B2
(45) Date of Patent: Apr. 15, 2008

(54) EXHAUST GAS PURIFICATION DEVICE FOR AN INTERNAL COMBUSTION ENGINE AND EXHAUST GAS PURIFICATION METHOD FOR AN INTERNAL COMBUSTION ENGINE

(75) Inventor: Koichiro Nakatani, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 405 days.

(21) Appl. No.: 10/545,130

(22) PCT Filed: Oct. 6, 2004

(86) PCT No.: PCT/JP2004/015103

§ 371 (c)(1),
(2), (4) Date: Aug. 10, 2005

(87) PCT Pub. No.: WO2005/038206

PCT Pub. Date: Apr. 28, 2005

(65) Prior Publication Data

US 2006/0107653 A1 May 25, 2006

(30) Foreign Application Priority Data

Oct. 17, 2003 (JP) ..... 2003-357668

(51) Int. Cl.

| | |
|---|---|
| ***B01D 53/56*** | (2006.01) |
| ***B01D 53/94*** | (2006.01) |
| ***F01N 3/18*** | (2006.01) |
| ***G05D 21/00*** | (2006.01) |

(52) U.S. Cl. ..... 423/213.2; 423/239.1; 423/DIG. 5; 422/105; 422/108; 422/111; 422/168; 422/176; 422/177; 422/180; 60/274; 60/282; 60/299; 60/302

(58) Field of Classification Search ..... 423/213.2, 423/239.1, DIG. 5; 422/105, 108, 111, 168, 422/176, 177, 180; 60/274, 282, 299, 302
See application file for complete search history.

(56) References Cited

U.S. PATENT DOCUMENTS 7,219,491 B2 * 5/2007 Nakatani ..... 60/286

FOREIGN PATENT DOCUMENTS

| | | |
|---|---|---|
| JP | A 62-106826 | 5/1987 |
| JP | A 03-175112 | 7/1991 |
| JP | A 06-200740 | 7/1994 |
| JP | A 06-235318 | 8/1994 |
| JP | A 2000-240428 | 9/2000 |
| JP | A 2000-240429 | 9/2000 |
| JP | A 2000-282843 | 10/2000 |
| JP | A 2000-345831 | 12/2000 |

* cited by examiner

*Primary Examiner*—Timothy C. Vanoy
(74) *Attorney, Agent, or Firm*—Oliff & Berridge, PLC

(57) ABSTRACT

An internal combustion engine with an exhaust gas purification device is provided in which the NOx held in a NOx catalyst can be efficiently reduced and purified, and a sufficient amount of NOx can be reduced, thereby making it possible to regenerate the NOx catalyst over a wide range thereof. When processing of releasing and reducing the NOx held in the NOx catalyst 33 for purification, light oil is injected by an addition valve 37 so as to be supplied to the NOx catalyst 33 together with the exhaust gas, and after the droplet-like light oil adheres to the entire area of the NOx catalyst 33, the flow rate of the exhaust gas is decreased.

23 Claims, 5 Drawing Sheets

EXHAUST GAS PURIFICATION DEVICE FOR AN INTERNAL COMBUSTION ENGINE AND EXHAUST GAS PURIFICATION METHOD FOR AN INTERNAL COMBUSTION ENGINE

TECHNICAL FIELD

The present invention relates to an exhaust gas purification device for an internal combustion engine and an exhaust emission control method for an internal combustion engine for purifying NOx components contained in an exhaust gas.

BACKGROUND ART

In the past, there has been known an exhaust gas purification device for an internal combustion engine that is provided with a NOx storage reduction catalyst to occlude and reduce NOx for purifying NOx components in an exhaust gas (see, for example, a first patent document (Japanese patent application laid-open No. 2000-240428), a second patent document (Japanese patent application laid-open No. H6-200740), a third patent document (Japanese patent application laid-open No. 2000-345831), and a fourth patent document (Japanese patent application laid-open No. S62-106826)). In such an exhaust gas purification device, a reducing agent is supplied to the NOx catalyst at appropriate times, so that NOx components contained in or held by the NOx catalyst are thereby reduced to be purified, thus regenerating the NOx catalyst.

Here, as methods for supplying the reducing agent to the NOx catalyst, in general, there are the following cases: that is, one case is that a liquid reducing agent is evaporated and then supplied in its gaseous state; and another case is that a liquid reducing agent is supplied in its liquid or droplet state. In the case of supplying a reducing agent in its gaseous state, there is a merit that a desired area can be put into a reducing atmosphere in a short period of time, but there is a demerit that it is impossible to reduce and purify the NOx held in the NOx catalyst unless the entire NOx catalyst has to be put into a reducing atmosphere. In contrast to this, in the case of supplying a reducing agent in its droplet state, there is a merit that it is possible to reduce the NOx held in the NOx catalyst by locally creating a reducing atmosphere without the need to put the entire NOx catalyst into a reducing atmosphere.

However, in the case of supplying a droplet-like reducing agent, there arises a problem that it is difficult to locally create a reducing atmosphere, so it becomes difficult to reduce and purify the NOx held in the NOx catalyst to a satisfactory extent. Here, note that if the amount of reducing agent supplied is too large, it is released or emitted to the atmosphere as it is without being adhered to the NOx catalyst, so the amount of the reducing agent to be supplied must be limited.

DISCLOSURE OF THE INVENTION

Accordingly, one object of the present invention is to reduce and purify the NOx held in a NOx catalyst in an efficient manner.

Another object of the present invention is to reduce and purify a sufficient amount of the NOx held in the NOx catalyst.

A further object of the present invention is to regenerate the NOx catalyst over a wide range thereof.

In order to solve the above-mentioned problems or objects, the present invention adopts the following solution.

That is, in the present invention, there is adopted a construction that after a liquid or droplet-like reducing agent has spread (adhered) to the entire NOx catalyst, the flow rate of an exhaust gas flowing through the NOx catalyst is decreased (including the case where the flow rate is reduced to zero).

According to such a construction of the present invention, the flow rate of the exhaust gas is not decreased at the time when the reducing agent is being supplied, so it is possible to easily supply the reducing agent to the whole from an upstream side to a downstream side of the NOx catalyst in a uniform manner. That is, the reducing agent is carried along with the exhaust gas, so in a state where the flow rate of the exhaust gas is decreased, it becomes difficult to supply the reducing agent to the downstream side of the NOx catalyst. In contrast to this, in the present invention, the reducing agent is supplied with the flow rate of the exhaust gas being not decreased, and hence the reducing agent can be supplied to the downstream side to a satisfactory extent. In addition, since the flow rate of the exhaust gas is decreased after the reducing agent has spread to the entire NOx catalyst, it is possible to widen an area of a reducing atmosphere formed around the droplet-like reducing agent adhered to the NOx catalyst as well as to keep the reducing atmosphere for a long period of time. That is, the reducing agent adhered to the NOx catalyst is evaporating, a reducing atmosphere is formed around the NOx catalyst during the progress of evaporation. Here, the gas, which forms the reducing atmosphere around the droplet-like reducing agent, is caused to flow along with the exhaust gas (which is not the reducing atmosphere). Accordingly, the less the flow rate of the exhaust gas, the wider the range of the reducing atmosphere can be made, and the longer in time the reducing atmosphere can be kept. Moreover, the flow rate of the exhaust gas is small, the region of the reducing atmosphere is wide, and the reducing atmosphere continues for a long period of time, as a result of which the temperature of the NOx catalyst rises quickly or at an early time. Thus, the NOx releasing and reducing speed or rate due to the NOx catalyst are increased, and the efficiency of purifying the NOx is raised in a synergistic manner.

As a more specific exhaust gas purification device for an internal combustion engine, according to the present invention, there is provided an exhaust gas purification device for an internal combustion engine in which a reducing agent supply means is disposed on an exhaust passage for supplying a droplet-like reducing agent to a NOx storage reduction catalyst, which serves to occlude and reduce NOx components in an exhaust gas, from its upstream side, so that the NOx components held in said NOx catalyst are reduced and purified by the reducing agent supplied thereto from said reducing agent supply means, said device being characterized by comprising:

a determination means for determining whether the droplet-like reducing agent supplied by said reducing agent supply means has spread to at least a predetermined range; and an adjustment means for adjusting a flow rate of the exhaust gas sent to said NOx catalyst;

wherein the flow rate of the exhaust gas is decreased by said adjustment means when said determination means makes a determination that the reducing agent has spread.

Here, it is preferable that the predetermined range is an entire range of the NOx catalyst, but it is not necessarily so. Further, in the present invention, even after the processing of decreasing the flow rate of the exhaust gas according to the adjustment means is started, the supply of the reducing agent may be continued. Moreover, as the adjustment means for the flow rate of the exhaust gas, there are enumerated, for example, a construction in which a plurality of exhaust gas passages are provided in such a manner that the amount of exhaust gas supplied to each passage is changed by a valve or the like, a construction that adopts a variable valve system, a construction in which the amount of intake air and/or the amount of exhaust gas are adjusted by intake and/or exhaust valves, a construction in which the amount of EGR is adjusted by an EGR valve, and a construction in which the amount of intake air is adjusted by a throttle valve. In addition, fuel (light oil in case of a diesel engine) is enumerated as a suitable example of the reducing agent.

According to such a construction of the present invention, the flow rate of the exhaust gas is not decreased at the time when the reducing agent is being supplied, so the reducing agent can be easily carried up to the downstream side of the NOx catalyst along with the exhaust gas. As a result, the reducing agent can be easily supplied to the whole from the upstream side of the NOx catalyst to the downstream side thereof. Accordingly, the reducing agent can be easily spread in the predetermined range in a uniform manner. In addition, since the flow rate of the exhaust gas is decreased after the reducing agent has spread in the predetermined range, it is possible to widen an area of the reducing atmosphere formed around the droplet-like reducing agent adhered to the NOx catalyst as well as to keep the reducing atmosphere for a long period of time. Further, the temperature of the NOx catalyst goes up quickly or at an early stage, so that the releasing and reducing speed or rate of the NOx due to the NOx catalyst are increased.

Moreover, when said determination means makes a determination that the reducing agent has spread, the supply of the reducing agent by said reducing agent supply means may be stopped, and thereafter the flow rate of the exhaust gas may be decreased by said adjustment means.

By doing so, the reducing agent can be prevented from being consumed more than necessary. In particular, even in case where a reducing agent containing HC (e.g., fuel) is used, it is possible to suppress the HC from being emitted or released to the atmosphere.

An element which becomes a determination reference or criterion according to said determination means may include at least one of the NOx purification ratio of said NOx catalyst, the amount of the HC emitted or exhausted to the downstream side of said NOx catalyst, the temperature of said NOx catalyst, the time elapsed from the start of supply of the reducing agent by said reducing agent supply means, and the flow rate of the exhaust gas that has passed through a unit volume of the catalyst within a unit time.

Here, when the NOx purification rate is used as an element that becomes a determination reference or criterion, it is possible to recognize, from the NOx purification rate after the processing of reducing and purifying the NOx held in the NOx catalyst is carried out by supplying the reducing agent, whether the reducing agent has spread in the predetermined range. Accordingly, the reducing agent can be made to spread in the predetermined range in an appropriate manner by performing so-called feedback control in which the supply time of the reducing agent is corrected when the following supply of the reducing agent is carried out. Here, note that the NOx purification rate means the ratio of a portion of the NOx purified by the NOx catalyst to the entire NOx exhausted from cylinders. For example, this NOx purification rate can be calculated, for example, from the results of detection of a pair of NOx sensors arranged at the upstream and downstream sides, respectively, of the NOx catalyst.

In addition, in the case of using, as an element for a determination criterion, the HC exhausted to the downstream side of the NOx catalyst, when it is detected that HC has been exhausted to the downstream side of the NOx catalyst, or when the amount of the HC exhausted to the downstream side of the NOx catalyst exceeds a predetermined amount, it can be determined that the reducing agent has spread in the predetermined range. The detection of HC can be performed by using an HC sensor. Here, note that in the case of using the HC as an element for a determination criterion, it is required that HC is contained as a component for the reducing agent.

Moreover, in the case of using the temperature of the NOx catalyst as an element for a determination criterion, when the temperature of the NOx catalyst exceeds a predetermined temperature (a preset temperature, or a temperature determined based on the reference temperature in consideration of other conditions), it is possible to determine that the reducing agent has spread in the predetermined range. In this connection, it is to be noted that the temperature of the NOx catalyst can be detected directly by the use of a temperature sensor, or estimated from a temperature at another location.

Moreover, in the case of using, as an element for a determination criterion, the time elapsed from the start of supply of the reducing agent by the reducing agent supply means, when the elapsed time exceeds a predetermined time, it can be determined that the reducing agent has spread in the predetermined range. In this regard, note that the elapsed time can be measured with the use of a timer. Here, a preset reference time, a time determined based on a reference time in consideration of other conditions or the like can be used as said predetermined time, and the flow rate of the exhaust gas (SV) having passed through the unit volume of the catalyst per unit time is referred to as a suitable example for the other conditions.

Here, note that the determination may be made by using only one of these elements for determination criteria, or by properly using two or more elements in a comprehensive manner.

In addition, it is preferable that a second determination means is provided for determining whether the adjustment of decreasing the flow rate of the exhaust gas by said adjustment means is to be terminated.

According to the above construction of the present invention, the processing of decreasing the flow rate of the exhaust gas can be terminated when appropriate. Accordingly, it is possible to return the flow rate of the exhaust gas to an ordinary level at the earliest possible stage.

The element which becomes a criterion for the determination of said second determination means may include at least one of the NOx purification rate of said NOx catalyst, the HC exhausted to the downstream side of said NOx catalyst, the temperature of said NOx catalyst, the time elapsed from the start of the adjustment of decreasing the flow rate of the exhaust gas by said adjustment means, and the flow rate of the exhaust gas having passed through the unit volume of said catalyst per unit time.

Here, in the case of using the NOx purification rate as an element for a determination reference or criterion, it is possible to recognize ex post facto, from the NOx purification rate after the processing of reducing and purifying the NOx held in the NOx catalyst is carried out by supplying the reducing agent, whether a time duration for which the flow rate of the exhaust gas has been decreased is appropriate.

Accordingly, it is possible to correct the time duration in an appropriate manner by performing so-called feedback control in which the time duration is corrected when the reducing agent is supplied at the next time.

In addition, in the case of using, as an element for a determination criterion, the HC exhausted to the downstream side of the NOx catalyst, when HC is stopped being exhausted to the downstream side of the NOx catalyst or when the amount of the HC exhausted to the downstream side of the NOx catalyst becomes less than a predetermined amount, it can be determined that the processing of reducing the flow rate of the exhaust gas is to be terminated.

Moreover, in the case of using the temperature of the NOx catalyst as an element for a determination reference, when the temperature of the NOx catalyst becomes less than a predetermined temperature (a preset reference temperature, a temperature determined based on a reference temperature in consideration of other conditions, etc.), it can be determined that the processing of reducing the flow rate of the exhaust gas is to be terminated.

Further, in the case of using, as an element for a determination criterion, the time elapsed from the start of the adjustment of decreasing the flow rate of the exhaust gas by said adjustment means, when the elapsed time exceeds a predetermined time (a second predetermined time), it can be determined that the processing of decreasing the flow rate of the exhaust gas is to be terminated. Here, a preset reference time, a time determined based on a reference time in consideration of other conditions or the like can be used as said predetermined time (the second predetermined time), and a flow rate of the exhaust gas (SV) having passed through the unit volume of the catalyst per unit time is enumerated as a suitable example for the other conditions.

Here, note that the determination may be made by using only one of these elements for determination criteria, or by properly using two or more elements in a comprehensive manner.

Also, it is preferable that the lower the temperature of said NOx catalyst, the more the flow rate of the exhaust gas is decreased by said adjustment means.

As a result, it is possible to properly adjust the flow rate of the exhaust gas in accordance with the temperature of the NOx catalyst. That is, the lower the temperature of the NOx catalyst, the more the speed at which the NOx held in the NOx catalyst is reduced is decreased. Therefore, the lower the temperature of the NOx catalyst, the higher the necessity of keeping the reducing atmosphere for a long period of time becomes. Accordingly, by decreasing the flow rate of the exhaust gas in accordance with the lowering temperature of the NOx catalyst, it becomes possible to keep the reducing atmosphere for the longer period of time, whereby the flow rate of the exhaust gas can be adjusted to a level corresponding to the temperature of the NOx catalyst.

Further, provision may be made for a first exhaust path and a second exhaust path arranged at the downstream side of said reducing agent supply means, with a NOx catalyst being provided on each of said first and second exhaust paths, and a valve for adjusting the flow rate of the exhaust gas with respect to each of these exhaust paths, wherein when the processing of reducing and purifying the NOx held in the NOx catalysts is not performed, the exhaust gas is caused to flow into both of the exhaust paths, whereas when said purification processing is performed, the supply of the reducing agent to one of said NOx catalysts by means of said reducing agent supply means is started with the exhaust gas being controlled by said valve to flow only into that one of said exhaust paths in which the one of said NOx catalysts to be processed for purification is arranged, and when the processing of decreasing the flow rate of the exhaust gas by means of said adjustment means is performed, the exhaust gas is controlled to flow into the other of said exhaust paths by said valve, whereby the flow rate of the exhaust gas to the one of said exhaust paths in which the one of said NOx catalysts to be processed for purification is arranged is decreased.

According to such a construction of the present invention, the exhaust passage is constituted by a plurality of paths in such a manner that the flow rate of the exhaust gas to each path can be properly changed, thereby achieving the decreasing processing of the flow rate of the exhaust gas. Additionally, when the processing of reducing and purifying the NOx is not performed, the exhaust gas is caused to flow into both of the first exhaust path and the second exhaust path in which the NOx catalysts are arranged, respectively. Accordingly, the NOx catalysts arranged in the exhaust paths, respectively, are both used, so there is no particular need to increase the capacity of the catalysts. Moreover, when the processing of reducing and purifying the NOx is performed, the reducing agent is supplied only to the one of the exhaust paths in which the one of said NOx catalysts to be processed is arranged. Accordingly, the reducing agent can be used without waste. Further, when the processing of decreasing the flow rate of the exhaust gas is performed, the flow rate of the exhaust gas to the other of said exhaust paths is increased by the valve, whereby the flow rate of the exhaust gas to the one of said exhaust paths in which the one of said NOx catalysts to be processed for purification is arranged is decreased. Accordingly, the processing of decreasing the flow rate of the exhaust gas to the one of said NOx catalysts to be purified can be done without changing the total amount of the flow rate of the exhaust gas.

Furthermore, when SOx held in the NOx catalysts is reduced and purified, and when particles adhered to the NOx catalysts, which also have a filter function, are oxidatively removed, processing of increasing and decreasing the flow rate of the exhaust gas flowing through that one of said exhaust paths in which the one of said NOx catalysts to be processed for purification is arranged is performed by said valve at least one time.

By doing so, it is possible to perform the reduction purification of the SOx or the oxidation removal of the particles over the entire area of the NOx catalysts in a suitable manner. That is, when these processing operations are performed, it is necessary to raise the temperature of the NOx catalysts to a value equal to or more than a predetermined temperature. In order to carry out these processing operations over the entire area of the NOx catalysts, the temperature of the entire area of the NOx catalysts must be raised to a value equal to or more than the predetermined temperature. Here, when the flow rate of the exhaust gas is small, the reducing agent is mainly supplied to the upstream side of the NOx catalysts, and hence the temperature of the NOx catalysts at the upstream side thereof becomes high mainly by the reductive reaction of said reducing agent, whereas when the flow rate of the exhaust gas is large, a lot of reducing agent is supplied to the downstream side of the NOx catalysts, so the temperature of the NOx catalysts at the downstream side thereof also becomes high by the reductive reaction of the reducing agent. Therefore, by performing the increasing and decreasing processing of the flow rate of the exhaust gas at least one time, the temperature of the NOx catalysts can be raised all around from the upstream side to the downstream side thereof.

In addition, said valve comprises a switch valve that is able to switch the path through which the exhaust gas flows to the first exhaust path or the second exhaust path, said increasing and decreasing processing is performed by said switch valve that alternately switches the path through which the exhaust gas flows between said first and second exhaust paths, and the timing at which the reducing agent is supplied by said reducing agent supply means is synchronized with the timing at which the path through which the exhaust gas flows may be switched by said switch valve.

By doing so, it is possible to appropriately carry out the increasing and decreasing processing of the flow rate of the exhaust gas with respect to both of the first exhaust path and the second exhaust path.

Moreover, an exhaust gas purification method for an internal combustion engine for purifying NOx contained in an exhaust gas according to the present invention comprises:

a step of making a droplet-like reducing agent adhere to a NOx storage reduction catalyst by supplying a reducing agent from an upstream side of said NOx catalyst that occludes and reduces NOx; and a step of decreasing the flow rate of the exhaust gas sent to the NOx catalyst after it is determined by a determination means that the droplet-like reducing agent has spread in at least a predetermined range in the NOx catalyst.

Here, note that the above-mentioned respective constructions can be adopted in combination with one another wherever possible.

As described in the foregoing, according to the present invention, it is possible to reduce and purify the NOx held in the NOx catalysts in an efficient manner. Also, it is possible to reduce and purify a sufficient amount of the NOx held in the NOx catalysts. In addition, the NOx catalysts can be regenerated over a wide range thereof.

BEST MODE FOR CARRYING OUT THE INVENTION

Now, the best mode for carrying out the present invention will be described below in detail, by way of example, based on the following embodiment while referring to the accompanying drawings. However, it is to be understood that the measurements, materials, configurations, relative arrangements and the like of component parts described in the following embodiment are only illustrative but should not be construed as limiting the scope of the present invention in any manner, in particular unless specified otherwise.

EXAMPLE 1

Figure 1:
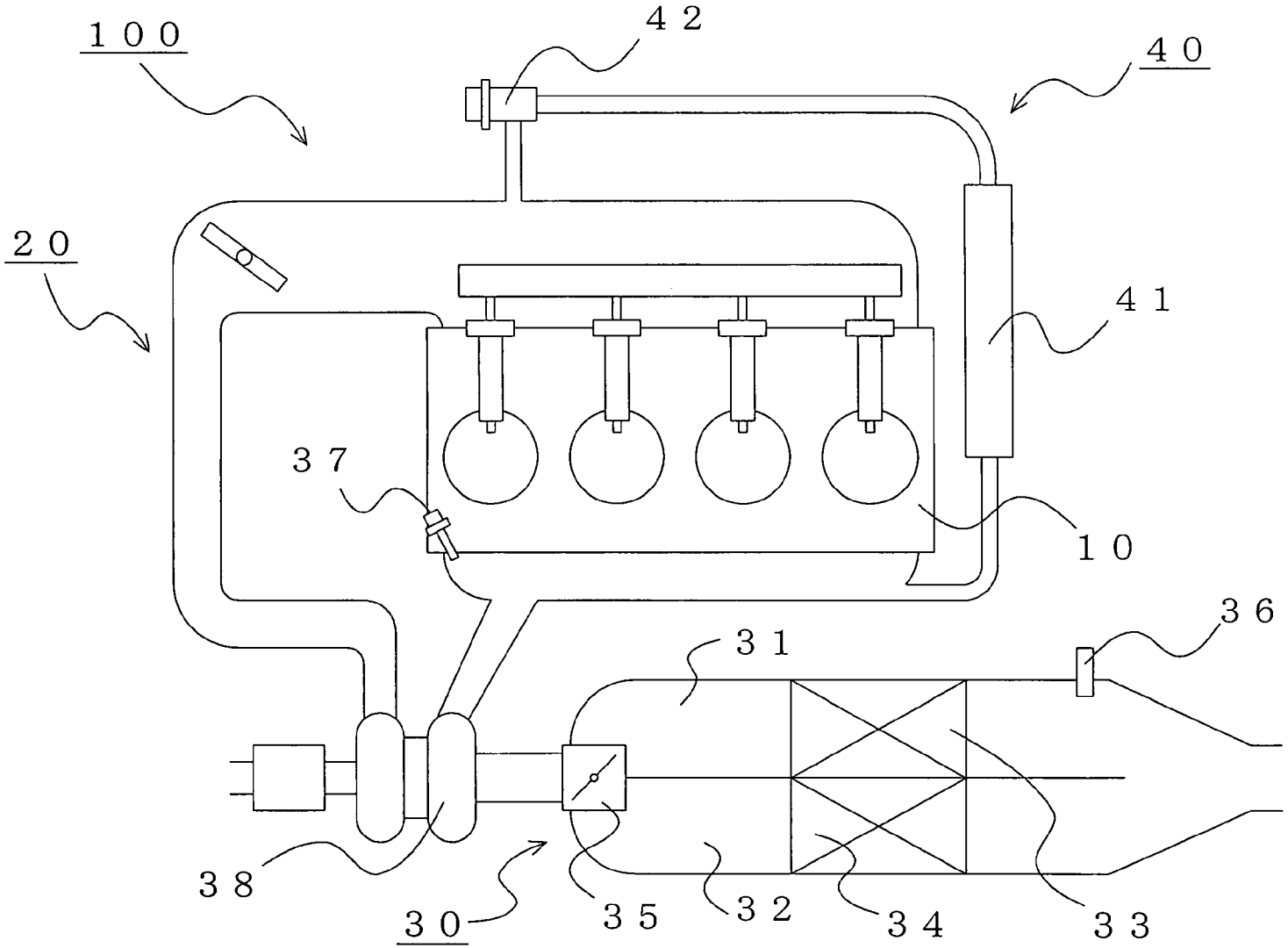
FIG. 1 is an overall schematic construction view of an internal combustion engine provided with an exhaust gas purification device.
Figure 2A:
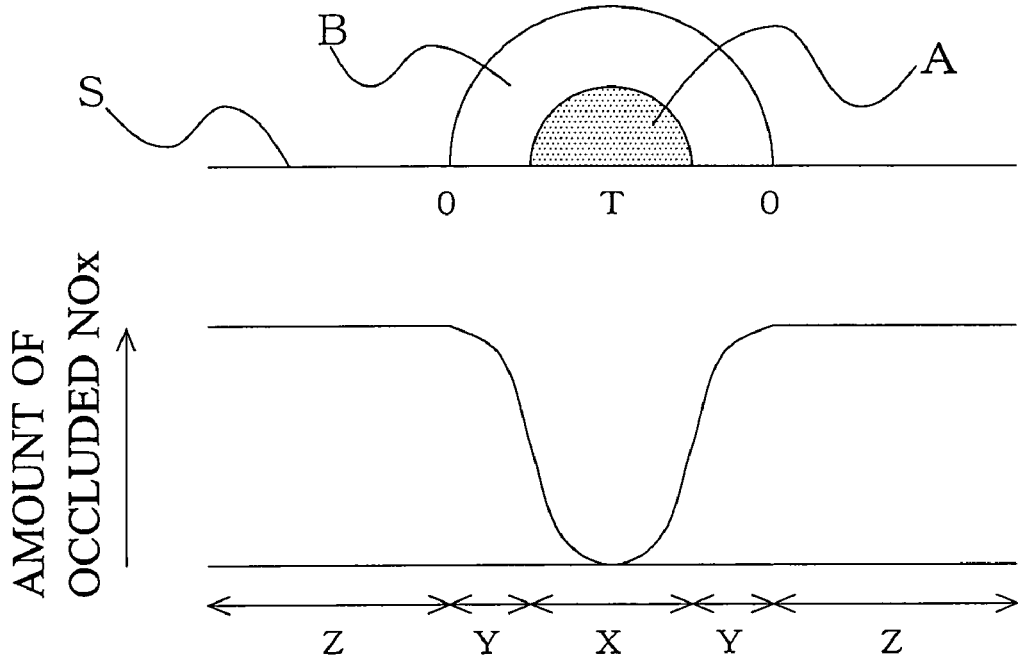
FIG. 2A is a view explaining a droplet-like reducing agent (in case of a large amount of SV).
Figure 2B:
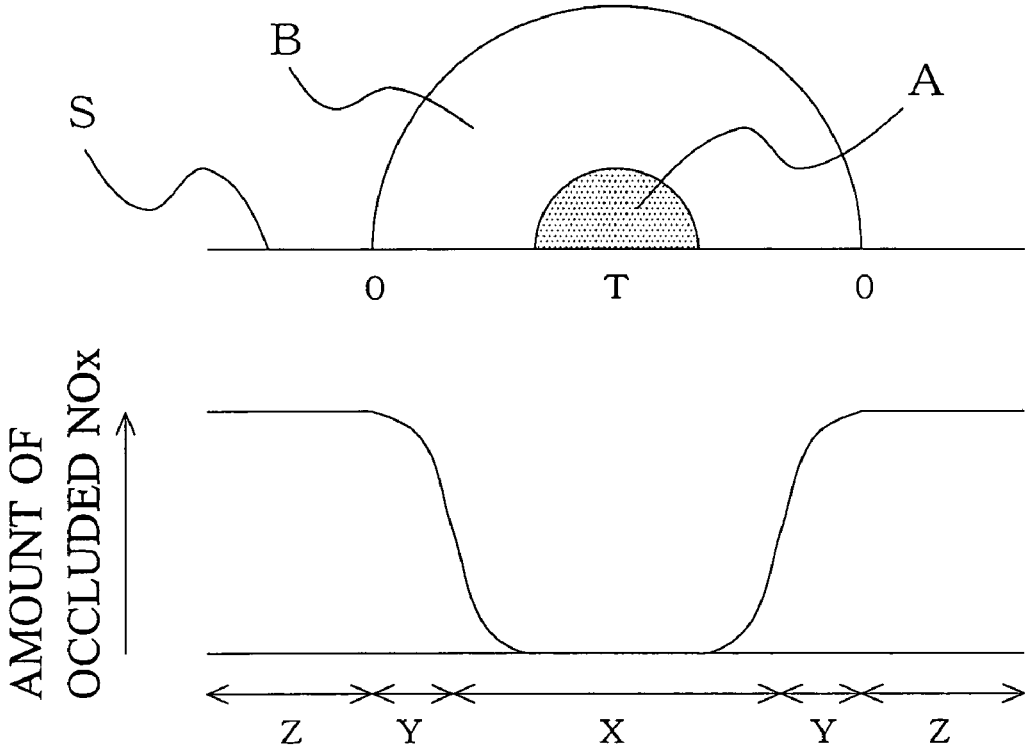
FIG. 2B is a view explaining the droplet-like reducing agent (in case of a small amount of SV).
Figure 3:
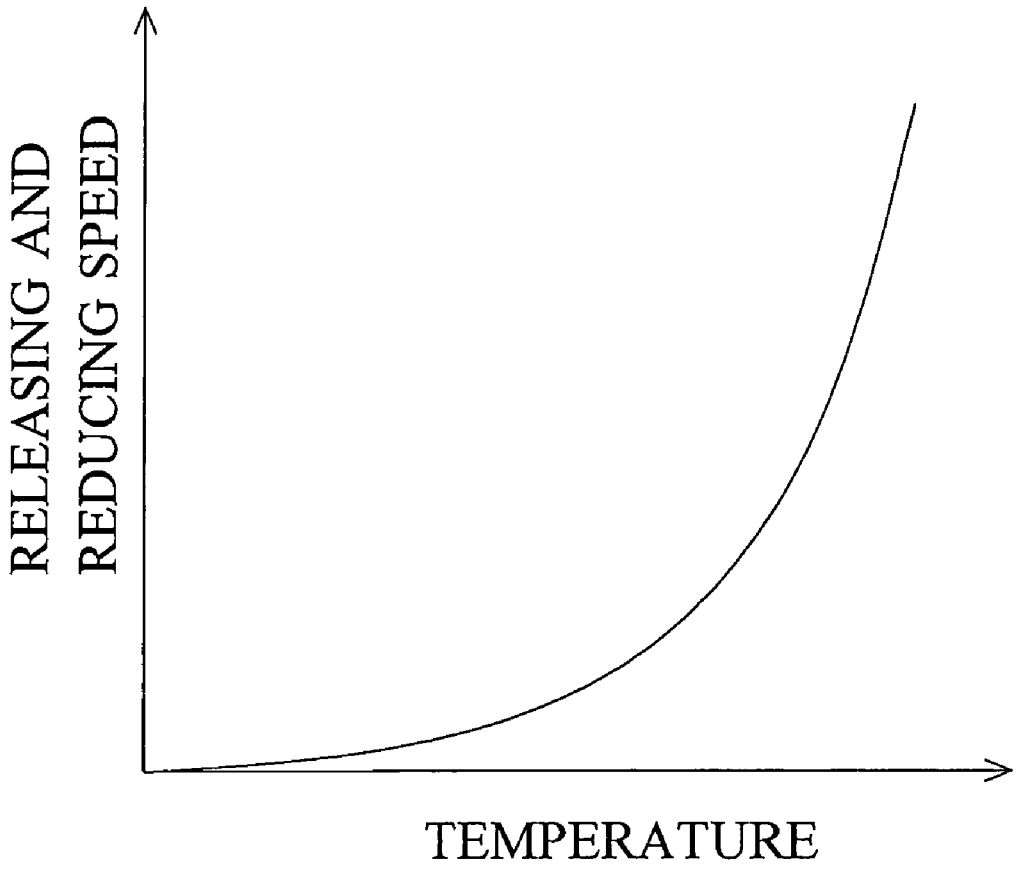
FIG. 3 is a graphic representation illustrating the relation between the temperature of a NOx catalyst and the speed at which the NOx held in the NOx catalyst is released and reduced.
Figure 4A:
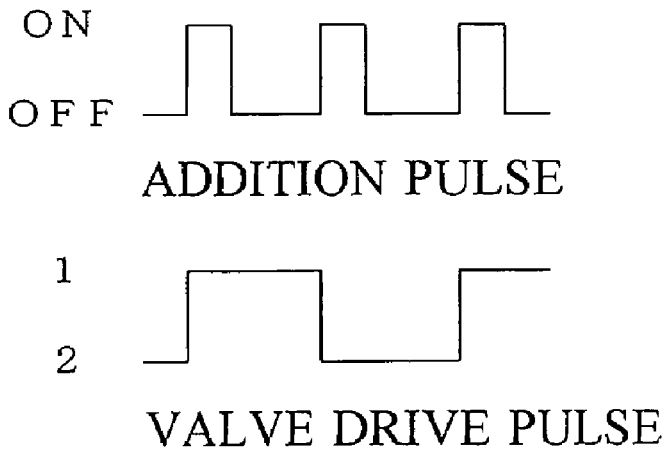
FIG. 4A is a timing chart (a preferred example) illustrating the relation between a pulse for driving a valve that switches an exhaust path and a pulse for adding the reducing agent.
Figure 4B:
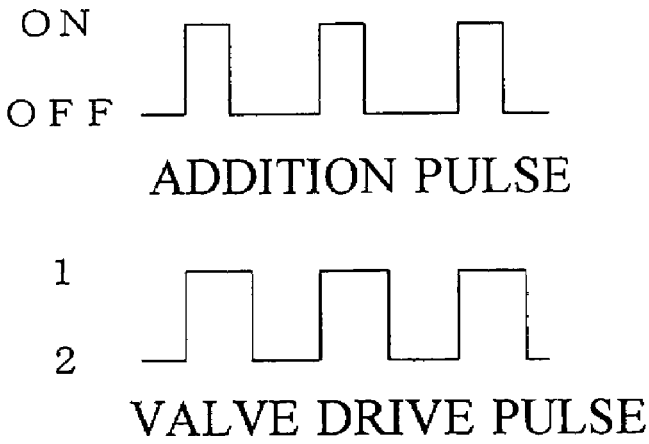
FIG. 4B is a timing chart (an inappropriate example) illustrating the relation between a pulse for driving the valve that switches the exhaust gas path and a pulse for adding the reducing agent.

An exhaust gas purification device for an internal combustion engine and an exhaust emission control method for an internal combustion engine according to a preferred embodiment of the present invention will be described with reference to FIG. 1 through FIG. 4. FIG. 1 is a schematic construction view of the entire internal combustion engine that is provided with the exhaust gas purification device. FIG. 2 is an explanatory view of a droplet-like reducing agent. That is, in FIG. 2, there are illustrated the manner in which the droplet-like reducing agent creates a reducing atmosphere, as well as a portion of the NOx catalyst to which the droplet-like reducing agent is adhered, and the amount of occlusion of the NOx therearound. Here, note that FIG. 2A shows the case where SV (the flow rate of the exhaust gas that has passed through the unit volume of the catalyst per unit time) is large, and FIG. 2B shows the case where SV is small. FIG. 3 is a graphic representation illustrating the relation between the temperature of the NOx catalyst and the speed at which the NOx held in the NOx catalyst is released and reduced. FIG. 4 is a timing chart illustrating the relation between a pulse for driving a valve that switches between exhaust paths and a pulse for adding the reducing agent. In this regard, FIG. 4A shows an appropriate or preferred example, and FIG. 4B shows an inappropriate example.

<Outline Explanation of the Internal Combustion Engine Provided with the Exhaust Gas Purification Device>

Now, the outline of the internal combustion engine 100 according to this embodiment will be described below with reference to FIG. 1. In this embodiment, description will be made while taking an example of a diesel engine as the internal combustion engine 100. The internal combustion engine 100 according to this embodiment includes an engine proper 10, an intake pipe 20 for supplying fresh air to the engine proper 10, an exhaust gas purification device 30 for purifying an exhaust gas exhausted from the engine proper 10 to release it to the atmosphere, and an exhaust gas recirculation device (EGR device) 40 for returning a part of the exhaust gas to an intake air so as to control the generation of NOx. The exhaust gas recirculation device 40 is provided with an EGR cooler 41 for cooling the returned exhaust gas (EGR gas).

<Explanation of the Exhaust Gas Purification Device>

The exhaust gas purification device 30 is provided with two exhaust paths, i.e., a first exhaust path 31 and a second exhaust path 32, in an exhaust pipe. NOx storage reduction catalysts 33, 34 are arranged in these exhaust paths, respectively. As an concrete example for these NOx catalysts, there are enumerated a NOx storage reduction catalyst, and a particulate filter carrying such a NOx storage reduction catalyst. In addition, a switch valve 35 capable of controlling the flow rate of the exhaust gas to these exhaust gas paths is arranged at a branch portion upstream of these exhaust gas paths. This switch valve 35 can be switched between the state in which both the entrance of a channel for the first exhaust path 31 and the entrance of a channel for the second exhaust path 32 are opened, and the state in which the entrance of one flow passage of these exhaust paths is opened, and the entrance of the other flow passage is closed. Also, the switch valve 35 can control the flow rate of the exhaust gas to each of the exhaust paths by adjusting the open area of the entrance of each flow passage to these exhaust gas paths.

A temperature sensor 36 is installed on the exhaust gas purification device 30 for measuring the temperatures of the NOx catalysts 33, 34. In addition, the addition valve 37 is arranged in an exhaust manifold upstream of the branch portion of the first exhaust path 31 and the second exhaust path 32 for supplying the reducing agent to these exhaust paths. In this embodiment, the reducing agent supplied by the addition valve 37 is a fuel (light oil).

<Outline of the Processing for Releasing and Reducing the NOx Held in the NOx Catalyst>

The NOx storage reduction catalysts 33, 34 according to this embodiment have a property that they absorb NOx under the condition that the exhaust gas contains a large proportion of oxidative components (oxidative atmosphere), but release NOx to the exhaust gas for reduction under the condition that the exhaust gas contains a small proportion of oxidative components with the presence of a reducing agent (HC, etc.) (reducing atmosphere).

Here, note that the NOx catalysts 33, 34 come to absorb NOx no more when a predetermined limit of NOx is absorbed. Accordingly, control for recovering the NOx absorption capabilities of the NOx catalysts 33, 34 is repeated at predetermined intervals by purifying the NOx catalysts 33, 34 through the release and reduction of the NOx held therein. Such control is performed based on a NOx purification rate, an operating history, etc.

When the processing of releasing and reducing the NOx held in the NOx catalysts 33, 34 is carried out, light oil, which serves as a reducing agent, is injected by the addition valve 37. The droplet-like light oil thus injected is carried to the downstream side of the exhaust paths together with the exhaust gas. As a result, the droplet-like light oil adheres to the NOx catalysts 33, 34. The droplet-like light oil adhered to the NOx catalysts 33, 34 is vaporized gradually to form a reducing atmosphere in the surroundings, and the NOx held in the NOx catalysts 33, 34 is released and reduced to be purified in a region where the reducing atmosphere has been formed. Here, the longer the time or duration of the reducing atmosphere, the amount of the NOx to be released and reduced increases.

<Procedure for Releasing and Reducing the NOx Held in the NOx Catalysts>

In this embodiment, both the entrance of the flow passage for the first exhaust path 31 and the entrance of the flow passage for the second exhaust path 32 are opened by the switch valve 35 at the time of normal operation (when the processing of releasing and reducing the NOx held in the NOx catalysts is not carried out).

Hereinafter, a procedure for the processing of releasing and reducing the NOx held in the NOx catalysts will be described in the order of processes to be done. Here, note that the processing of either of the NOx catalyst 33 arranged in the first exhaust path 31 and the NOx catalyst 34 arranged in the second exhaust path 32 is carried out according to the same procedure. Accordingly, reference herein will be made to only the case where processing of the NOx catalyst 33 arranged in the first exhaust path 31 is carried out.

<<Procedure>>

First of all, by means of the switch valve 35, the entrance of the flow passage for the second exhaust path 32 is closed and the entrance of the flow passage for the first exhaust path 31 is opened so that light oil is supplied by being injected from the addition valve 37. The light oil thus injected is carried to the downstream side of the first exhaust path 31 together with the exhaust gas. As a result, the droplet-like light oil is adhered to the NOx catalyst 33 arranged in the first exhaust path 31. Here, in this embodiment, the droplet-like light oil is carried with the flow rate of the exhaust gas being sufficiently large, so light oil is supplied to the downstream side of the NOx catalyst 33 to a satisfactory extent.

When a determination is made by an unillustrated determination section that the light oil has spread in the predetermined range (in this embodiment, the entire region of the NOx catalyst 33), the supply of the light oil by the addition valve 37 is stopped. Thereafter, the entrance of the flow passage for the second exhaust path 32 is opened by the switch valve 35, so that the exhaust gas comes to flow into the second exhaust path 32, thereby decreasing the flow rate of the exhaust gas flowing into the first exhaust path 31.

Then, when by an unillustrated second determination section that determines whether the adjustment of decreasing the flow rate of the exhaust gas is to be terminated, it is determined that the flow rate decreasing adjustment is to be terminated, the switch valve 35 returns to its original position. However, with respect to the NOx catalyst 33 arranged in the first exhaust path 31 and the NOx catalyst 34 arranged in the second exhaust path 32, in general, it is necessary to perform the processing of releasing and reducing the NOx held in the NOx catalysts at the same time. Accordingly, it is desirable to apply the above processing to the NOx catalyst 34 continuously after application of the processing to the NOx catalyst 33.

<<The Determination Section to Determine Whether the Light Oil has Spread in the Predetermined Range>>

The determination section to determine whether the light oil has spread in the predetermined range is one of the functions that an unillustrated control unit (ECU) has for controlling the operation of various component parts provided of the internal combustion engine 100. The ECU is a device that arithmetically processes electric signals input from various kinds of sensors by means of a microcomputer, and outputs electric signals to various kinds of actuators through an output processing circuit. Here, it is needless to say that the actuators to which electric signals are output from the ECU after the determination of the determination section are the addition valve 37 and the switch valve 35 in this embodiment. Though a variety of techniques can be adopted as such a determination technique of the determination section, some examples thereof will be described herein.

(1) Determination Using the NOx Purification Rate

From the NOx purification rate after the processing of purifying the NOx held in the NOx catalysts for reduction is carried out, it is possible to recognize ex post facto whether the light oil acting as the reducing agent had spread in the predetermined range. This is because in general, if the light oil has actually spread in the predetermined range, the NOx purification rate exceeds a target value, whereas if not, the NOx purification rate becomes less than the target value. Accordingly, it is possible to make the light oil spread in the predetermined range in an appropriate manner by performing so-called feedback control in which the supply time or duration of the light oil is corrected when the light oil is supplied at the next time. Here, note that the NOx purification rate means the ratio of that portion of the NOx exhausted from the cylinders which is purified (absorbed) by the NOx catalysts among the entire NOx. For example, this NOx purification rate can be calculated from the results of detection of a pair of NOx sensors arranged at locations upstream and downstream of the NOx catalysts.

That is, in this case, electric signals are input to the ECU from the NOx sensors arranged upstream and downstream of the NOx catalysts, respectively. The ECU calculates the NOx purification rate from these input signals, and when the NOx purification rate thus calculated is less than a target NOx purification rate, it further calculates a difference between of these purification rates, from which the ECU can calculate a correction value for the light oil supply time when the light oil is supplied at the next time.

(2) Determination Using HC Exhausted to a Downstream Side of the NOx Catalysts

When it is detected that HC has been exhausted to the downstream side of each NOx catalyst or when the amount of the HC exhausted to the downstream side of each NOx catalyst has exceeded a predetermined amount, it is possible to determine that the light oil has spread in the predetermined range. This is because if HC is exhausted to the downstream side of each NOx catalyst, it is considered that the light oil has reached a downstream end of each NOx catalyst, and if the amount of the HC exhausted to the downstream side of each NOx catalyst exceeds the predetermined amount, it is considered that the light oil in each NOx catalyst has spread to a predetermined extent. Here, note that the detection of HC can be performed by using an HC sensor.

(3) Determination Using the Temperatures of the NOx Catalysts

When the temperature of each NOx catalyst exceeds a predetermined temperature (a preset reference temperature, a temperature determined based on a reference temperature in consideration of other conditions, etc.), it is possible to determine that the light oil has spread in the predetermined range. This is because the temperature of each NOx catalyst rises in accordance with an increasing area where the light oil has been supplied. Here, note that the temperature of each NOx catalyst can be detected by the temperature sensor 36.

(4) Determination Using the Time Elapsed

When the time elapsed from the start of supply of the light oil by the addition valve 37 exceeds a predetermined time, it is possible to determine that the light oil has spread in the predetermined range. This is because the relation between the supply time of the light oil and the range where the light oil has spread can be estimated by experiments and analyses. In this regard, note that the elapsed time can be measured with the use of a timer. Here, a preset reference time, a time determined based on a reference time in consideration of other conditions or the like can be used as the "predetermined time", and the flow rate of the exhaust gas (SV) having passed through the unit volume of each catalyst per unit time is enumerated as a suitable example for the other conditions.

(5) Others

The determination methods (1)-(4) described above can be used singly or independently, but it is possible to use two or more of these determination methods in combination. For example, by adopting these determination methods (2)-(4), when it is determined according to all these determination methods that "the light oil has spread in the predetermined range", a final determination can be made that "the light oil has spread in the predetermined range". In addition, the determination method (1) can be combined with either of the determination methods (2)-(4). Specifically, in the case of adopting either of these determination methods (2)-(4), an error can occur in the determination result, so to cope with this, it is possible to make a more appropriate determination by applying the feedback control in (1).

<<Relation Between the Flow Rate of the Exhaust Gas and the Amount of the NOx Released from the NOx Catalysts for Reduction>>

The relation between the flow rate of the exhaust gas and the amount of NOx to be released and reduced from the NOx catalyst will be described with particular reference to FIG. 2A and FIG. 2B. In these figures, the appearance of the droplet-like light oil adhered to a surface of a NOx catalyst is schematically illustrated in an upper portion, and the amount of occlusion of NOx in the NOx catalyst is illustrated in a lower portion. FIG. 2A indicates the case where SV is large, and FIG. 2B indicates the case where SV is small.

In these figures, a reference character S designates the surface of the NOx catalyst; a reference character A indicates the droplet-like light oil adhered to the surface S of the NOx catalyst, and a reference character B indicates a reducing atmosphere region. The droplet-like light oil A adhered to surface S of the NOx catalyst evaporates from its surface through vaporization to form the reducing atmosphere range B therearound. The time or duration for which the state of the reducing atmosphere formed in this manner is maintained is the longest in the center (T in these figures) of the droplet-like light oil A adhered to the surface S of the NOx catalyst, and it shortens or decreases as the distance from the light oil A increases. Here, note that the part indicated at 0 in these figures is a part in which the formation of the reducing atmosphere is 0 in time. That is, the solid line position indicated by 0 is a limit position at which the reducing atmosphere can be formed by the light oil A. Here, note that the amount of the NOx to be released and reduced from the NOx catalyst increases as the time or duration of the reducing atmosphere increases. Accordingly, a large amount of NOx is released and reduced in the vicinity of the center of the light oil A adhered to the surface of the NOx catalyst (a region indicated at X in the figures), but the larger the distance from there (a region indicated at Y in the figures), the more insufficient does the amount of the NOx to be released and reduced become, so NOx is not released at all in a region (a region indicated at Z in the figures) where no reducing atmosphere is formed.

In this connection, note that a gas forming the reducing atmosphere is caused to flow along with the exhaust gas, which is an oxidative atmosphere in the case of the diesel engine. As a result, the larger the flow rate of the exhaust gas, the faster the gas forming the reducing atmosphere is caused to flow. Accordingly, the smaller the flow rate of the exhaust gas, the wider the range of the reducing atmosphere can be made, so the longer in time the reducing atmosphere can be kept. From the above, as can be seen from a comparison between FIG. 2A and FIG. 2B, the smaller the SV, the larger does the amount of NOx to be released and reduced from the NOx catalyst become, and the NOx catalyst can be regenerated over the wider range. In addition, the smaller the SV, the faster does the temperature of the NOx catalyst rise, so the faster does the speed at which the NOx held in the NOx catalyst is released and reduced become, thereby improving the efficiency of releasing and reducing the NOx in a synergistic manner.

<<Adjustment for the Flow Rate of the Exhaust Gas According to the Temperature of the NOx Catalyst>>

As stated above, the NOx catalyst has a property that the speed at which the NOx held in the NOx catalyst is released and reduced becomes faster in accordance with the rising or increasing temperature thereof (see FIG. 3). Accordingly, in the case of performing the processing of releasing and reducing the NOx, the higher the temperature of the NOx catalyst, the shorter the time for which the reducing atmosphere is maintained may be, whereas the lower the temperature of the NOx catalyst, the longer the time for which the reducing atmosphere is maintained need be. In addition, in case where the temperature of the NOx catalyst is low, it is possible to raise the temperature of the NOx catalyst at an early stage by increasing the time for which the reducing atmosphere is maintained, as well as making the region of the reducing atmosphere wider.

From the above, in this embodiment, when the flow rate of the exhaust gas is adjusted to decrease, the amount of the decreasing adjustment is changed in accordance with the temperature detected by the temperature sensor 36. That is, the lower the detected temperature, the more the flow rate of the exhaust gas is decreased. By doing so, the lower the temperature of the NOx catalyst, it is possible to increase the time for which the reducing atmosphere is maintained, and to make the range of the reducing atmosphere wider. As described above, in this embodiment, the flow rate of the exhaust gas can be adjusted to an optimal level in accordance with the temperature of the NOx catalyst.

<<The Second Determination Section to Determine Whether the Adjustment of Decreasing the Flow Rate of the Exhaust Gas is to be Terminated>>

When the light oil adhered to the NOx catalyst has fully vaporized (evaporated) and the releasing and reducing processing of the NOx held in the NOx catalysts is terminated, it is necessary to return the flow rate of the exhaust gas to an original level. Accordingly, by using the second determination section which determines whether the adjustment of decreasing the flow rate of the exhaust gas is to be terminated, the flow rate of the exhaust gas is returned to the original level when it is determined by the second determination section that the decreasing adjustment is to be terminated. Thus, deterioration of drivability due to the control of decreasing the flow rate can be suppressed to a minimum by returning the flow rate of the exhaust gas to an ordinary level at appropriate timing. The second determination section is one of the functions that the ECU has, similar to the above-mentioned determination section which determines whether the light oil has spread in the predetermined range.

Here, note that the NOx purification rate, the HC exhausted to the downstream side of the NOx catalysts, the temperatures of the NOx catalysts, the elapsed time, etc., can be used as a determination technique or method according to the second determination section, as in the case of the determination section for determining whether the light oil has spread in the predetermined range. The reason why these factors can be used in the determination technique or method according to the second determination section can be clear from the above-mentioned explanation of the determination technique according to the determination section which determines whether the light oil has spread in the predetermined range. Thus, a detailed explanation thereof is omitted.

<SOx Poisoning Recovery and Oxidation Removal of PM>

In general, the NOx catalyst has a property that absorbs not only the NOx but also the SOx contained in the exhaust gas. As the amount of the SOx held in the NOx catalyst increases, so-called SOx poisoning is caused in which the capability of absorbing NOx is decreased. Accordingly, in order to eliminate such SOx poisoning, the processing of removing the SOx held in the NOx catalyst through the release and reduction thereof (SOx poisoning recovery processing) is carried out at appropriate times. Additionally, in general, in case where the NOx catalyst also has a filter function, as in the case when the NOx catalyst is in the form of a particulate filter carrying the above-mentioned NOx storage reduction catalyst for example, the processing of oxidatively removing captured particulate materials (PM: particulate matter) (PM oxidation removal processing) is timely carried out.

When these SOx poisoning recovery processing and PM oxidation removal processing are performed, it is necessary to raise the temperature of the NOx catalyst to a high temperature (e.g., 600 degrees). Thus, to perform SOx poisoning recovery and PM oxidation removal over the entire area of the NOx catalyst, it is necessary to make the entire area of the NOx catalyst to the high temperature.

Accordingly, in this embodiment, when these processing operations are carried out, the path through which the exhaust gas flows is alternately switched between the first exhaust path 31 and the second exhaust path 32 by means of the switch valve 35. Here, note that such switching need only to be done at least one time. As a result, in each of the exhaust paths, the exhaust gas changes, at least one time, from a state in which the SV is small to a state in which the SV is high (or vice versa). Accordingly, by injecting the light oil from the addition valve 37 during such time, it is possible to supply the light oil to all around the entire areas of the NOx catalysts 33, 34. As a consequence, the entire areas of the NOx catalysts 33, 34 can be uniformly made at a high temperature.

Here, reference will be made to the driving timing of the switch valve 35 and the injection timing of the light oil by the addition valve 37 when these processing operations are carried out while referring to FIG. 4. FIG. 4 is a timing chart that illustrates the relation between a valve driving pulse sent to the switch valve 35 and an addition pulse sent to the addition valve 37. When the addition pulse is turned on or at a high level, the light oil is injected by the addition valve 37, whereas when the addition pulse is turned off or at a low level, the addition valve 37 is stopped so the light oil is not injected. Also, when the valve drive pulse is at 1 (high), only the entrance of the flow passage for the first exhaust path 31 is opened by the switch valve 35, whereas when the valve drive pulse is at 2 (low), only the entrance of the flow passage for the second exhaust path 32 is opened by the switch valve 35.

FIG. 4A represents a preferred or appropriate example. According to the timing chart illustrated in FIG. 4A, the light oil is injected by the addition valve 37 in synchronization with the timing at which the path through which the exhaust gas flows is switched to the first exhaust path 31, and to the second exhaust path 32. In this case, substantially the same amounts of light oil can be supplied to the first exhaust path 31 and the second exhaust path 32, respectively, under the condition of the same flow rate of the exhaust gas. Accordingly, appropriate processing can be done with respect to both of the NOx catalysts 33, 34.

On the other hand, FIG. 4B represents an inappropriate example. According to the timing chart illustrated in FIG. 4B, the light oil is injected by the addition valve 37 in synchronization with the timing at which the path through which the exhaust gas flows is switched to the first exhaust path 31 alone. In this case, the amounts of light oil to be supplied to the first exhaust path 31 and the second exhaust path 32 are different from each other, and the flow rates of the exhaust gas when the light oil is supplied to the first and second flow paths are also different from each other. Accordingly, appropriate processing can not be done with respect to the NOx catalysts 33, 34.

<Advantageous Effects Achieved by the Internal Combustion Engine Provided with the Exhaust Gas Purification Device According to this Embodiment>

As described in the foregoing, according to the internal combustion engine provided with the exhaust gas purification device and the exhaust emission control method for an internal combustion engine according to this embodiment, when the processing of releasing and reducing the NOx held in the NOx catalysts 33, 34 is carried out, the droplet-like light oil can be easily adhered to all around the entire areas of the NOx catalysts 33, 34, so the region of the reducing atmosphere formed by individual droplets of the light oil can be widened, and the state of the reducing atmosphere can be maintained for a long period of time. In addition, the temperature of the NOx catalyst goes up quickly or at an early stage, so that the releasing and reducing speed or rate of NOx due to the NOx catalyst can be enhanced. Accordingly, the NOx held in the NOx catalysts 33, 34 can be efficiently reduced and purified, and a sufficient amount of NOx can be reduced.

In addition, the NOx catalysts 33, 34 can be regenerated over their wide ranges or areas to a satisfactory extent.

<Others>

In this embodiment, as a processing method of decreasing the flow rate of the exhaust gas, there is adopted the method of arranging two exhaust paths and adjusting the flow rate of the exhaust gas to each of the exhaust paths. However, it is needless to say that three or more exhaust paths can be provided to decrease the flow rate of the exhaust gas by adjusting the flow rate of the exhaust gas to each of the exhaust paths. In addition, as a processing method or scheme of decreasing the flow rate of the exhaust gas, other than the above, there are enumerated a construction that adopts a variable valve system, a construction in which the amount of intake air and/or the amount of exhaust gas can be adjusted by intake and/or exhaust valves, a construction in which the amount of EGR is adjusted by an EGR valve, and a construction in which the amount of intake air is adjusted by a throttle valve. Specifically, for example, the flow rate of the exhaust gas can be decreased by shortening the valve-opening duration of each of intake and exhaust valves by means of a variable valve system, or by adjusting a throttle valve to its closing side and an EGR valve to its opening side, or by squeezing an exhaust throttle valve (=a valve arranged in an exhaust passage: this is different from a so-called VVT exhaust valve which is installed on a truck, etc., so that it is throttled so as to be used as an engine brake at the time of deceleration).

In addition, in this embodiment, after the injection of the light oil by the addition valve 37 is terminated, the processing of decreasing the flow rate of the exhaust gas is performed. This is mainly due to the viewpoint of eliminating unnecessary consumption of the light oil, but the injection of the light oil by the addition valve 37 may be somewhat continued after the processing of decreasing the flow rate of the exhaust gas has been started.

Moreover, in this embodiment, there is shown the construction in which the switch valve 35 for switching the path through which the exhaust gas flows between the first exhaust path 31 and the second exhaust path 32 is arranged at a branch point upstream of these exhaust paths, but such a switch valve for switching the flow path of the exhaust gas between the exhaust paths may be arranged at a confluence or junction point downstream of these exhaust paths. The former construction is better in guiding the light oil to a desired one of the exhaust paths in a reliable manner, but the latter construction is better when considering the environmental temperature.

Further, in this embodiment, by arranging the addition valve 37 in the exhaust manifold, the distances from the addition valve 37 to the NOx catalysts 33, 34 can be made long enough. As a result, the temperature of the fuel in the form of the light oil injected from the addition valve 37 rises to a satisfactory extent, so the light oil becomes a readily vaporable or evaporable state. In addition, the addition valve 37 is arranged at a location upstream of a turbo 38. Accordingly, the fuel flowing into the turbo 38 is stirred therein, so the fuel can be made to reach the NOx catalysts 33, 34 in a relatively uniform manner.

The invention claimed is:

1. An exhaust gas purification device for an internal combustion engine in which a reducing agent supply means is disposed on an exhaust passage for supplying a droplet-like reducing agent to a NOx storage reduction catalyst, which serves to occlude and reduce NOx components in an exhaust gas, from its upstream side, so that NOx components held in said NOx catalyst are reduced and purified by the reducing agent supplied thereto by said reducing agent supply means, said device being characterized by comprising:

a determination means for determining whether the droplet-like reducing agent supplied by said reducing agent supply means has spread to at least a predetermined range; and an adjustment means for adjusting a flow rate of the exhaust gas sent to said NOx catalyst;

wherein the flow rate of the exhaust gas is decreased by said adjustment means when said determination means makes a determination that said reducing agent has spread.

2. The exhaust gas purification device for an internal combustion engine as set forth in claim 1, characterized in that when said determination means makes a determination that said reducing agent has spread, the supply of the reducing agent by said reducing agent supply means is stopped, and thereafter the flow rate of the exhaust gas is decreased by said adjustment means.

3. The exhaust gas purification device for an internal combustion engine as set forth in claim 1, characterized in that an element which becomes a criterion for the determination of said determination means is a NOx purification rate of said NOx catalyst.

4. The exhaust gas purification device for an internal combustion engine as set forth in claim 1, characterized in that an element which becomes a criterion for the determination of said determination means is HC exhausted to a downstream side of said NOx catalyst.

5. The exhaust gas purification device for an internal combustion engine as set forth in claim 1, characterized in that an element which becomes a criterion for the determination of said determination means is a temperature of said NOx catalyst.

6. The exhaust gas purification device tor an internal combustion engine as set forth in claim 1, characterized in that an element which becomes a criterion for the determination of said determination means is a time elapsed from the start of supply of the reducing agent by said reducing agent supply means.

7. The exhaust gas purification device for an internal combustion engine as set forth in claim 6, characterized in that said determination means determines that the reducing agent has spread in the predetermined range when the time elapsed from the start of supply of the reducing agent by said reducing agent supply means exceeds a predetermined time.

8. The exhaust gas purification device for an internal combustion engine as set forth in claim 7, characterized in that said predetermined time is a preset reference time, or a time that is set based on said reference time in consideration of a flow rate of the exhaust gas having passed through a unit volume of said catalyst per unit time.

9. The exhaust gas purification device for an internal combustion engine as set forth in claim 1, characterized in that an element which becomes a criterion for the determination of said determination means includes at least one of a NOx purification rate of said NOx catalyst, HC exhausted to a downstream side of said NOx catalyst, a temperature of said NOx catalyst, a time elapsed from the start of supply of the reducing agent by said reducing agent supply means, and a flow rate of the exhaust gas having passed through a unit volume of said catalyst per unit time.

10. The exhaust gas purification device for an internal combustion engine as set forth in claim 1, characterized by further comprising a second determination means for determining whether the adjustment of decreasing the flow rate of the exhaust gas by said adjustment means is to be terminated.

11. The exhaust gas purification device for an internal combustion engine as set forth in claim 10, characterized in that an element which becomes a criterion for the determination of said second determination means is the NOx purification rate of said NOx catalyst.

12. The exhaust gas purification device for an internal combustion engine as set forth in claim 10, characterized in that an element which becomes a criterion for the determination of said second determination means is HG exhausted to the downstream side of said NOx catalyst.

13. The exhaust gas purification device for an internal combustion engine as set forth in claim 10, characterized in that an element which becomes a criterion for the determination of said second determination means is the temperature of said NOx catalyst.

14. The exhaust gas purification device for an internal combustion engine as set forth in claim 10, characterized in that an element which becomes a criterion for the determination of said second determination means is a time elapsed from the start of the adjustment of decreasing the flow rate of the exhaust gas by said adjustment means.

15. The exhaust gas purification device for an internal combustion engine as set forth in claim 14, characterized in that said second determination means determines that the adjustment of decreasing the flow rate of the exhaust gas by said adjustment means is to be terminated when the time elapsed from the start of the adjustment of decreasing the flow rate of the exhaust gas by said adjustment means exceeds a second predetermined time.

16. The exhaust gas purification device for an internal combustion engine as set forth in claim 15, characterized in that said second predetermined time is a preset reference time, or a time that is set based on said reference time in consideration of a flow rate of the exhaust gas having passed through a unit volume of said catalyst per unit time.

17. The exhaust gas purification device for an internal combustion engine as set forth in claim 10, characterized in that an element which becomes a criterion for the determination of said second determination means includes at least one of a NOx purification rate of said NOx catalyst, HC exhausted to a downstream side of said NOx catalyst, a temperature of said NOx catalyst, a time elapsed from the start of the adjustment of decreasing the flow rate of the exhaust gas by said adjustment means, and a flow rate of the exhaust gas having passed through a unit volume of said catalyst per unit time.

18. The exhaust gas purification device for an internal combustion engine as set forth in claim 1, characterized in that the lower the temperature of said NOx catalyst, the more the flow rate of the exhaust gas is decreased by said adjustment means.

19. The exhaust gas purification device for an internal combustion engine as set forth in claim 1, characterized by further comprising:

a first exhaust path and a second exhaust path arranged at a downstream side of said reducing agent supply means, with a NOx catalyst being provided on each of said first and second exhaust paths; and a valve that adjusts the flow rate of the exhaust gas with respect to each of said exhaust paths;

wherein when the processing of reducing and purifying the NOx held in the NOx catalysts is not performed, the exhaust gas is caused to flow into each of said exhaust paths;

when said purification processing is performed, the supply of the reducing agent to one of said NOx catalysts by means of said reducing agent supply means is started with the exhaust gas being controlled by said valve to flow only into that one of said exhaust paths in which the one of said NOx catalysts to be processed for purification is arranged, and when the processing of decreasing the flow rate of the exhaust gas by means of said adjustment means is performed, the exhaust gas is controlled to flow into the other of said exhaust paths by said valve, whereby the flow rate of the exhaust gas to the one of said exhaust paths in which the one of said NOx catalysts to be processed for purification is arranged is decreased.

20. The exhaust gas purification device for an internal combustion engine as set forth in claim 19, characterized in that when SOx held in said NOx catalysts is reduced and purified, and when particles adhered to said NOx catalysts, which also have a filter function, are oxidatively removed, processing of increasing and decreasing the flow rate of the exhaust gas flowing through that one of said exhaust paths in which one of said NOx catalysts to be processed for purification is arranged is performed by said valve at least one time.

21. The exhaust gas purification device for an internal combustion engine as set forth in claim 20, characterized in that said valve comprises a switch valve that is able to switch a path through which the exhaust gas flows to said first exhaust path or said second exhaust path;

said increasing and decreasing processing is performed by said switch valve that alternately switches the path through which the exhaust gas flows between said first and second exhaust paths; and the timing at which the reducing agent is supplied by said reducing agent supply means is synchronized with the timing at which the path through which the exhaust gas flows is switched by said switch valve.

22. The exhaust gas purification device for an internal combustion engine as set forth in claim 21, characterized in that after the reducing agent is started to be supplied by said reducing agent supply means in synchronization with the timing at which the path through which the exhaust gas flows is switched to either one of said first and second exhaust paths by means of said switch valve, the supply of the reducing agent is stopped during the time when the exhaust gas is flowing through said one of said first and second exhaust paths, and thereafter the reducing agent is started to be supplied by said reducing agent supply means in synchronization with the timing at which the path through which the exhaust gas flows is switched to the other of said first and second exhaust paths by said switch valve.

23. An exhaust gas purification method for an internal combustion engine for purifying NOx contained in an exhaust gas, said method comprising:

a step of making a droplet-like reducing agent adhere to an occlusion reduction type NOx catalyst by supplying a reducing agent from an upstream side of said NOx catalyst that occludes and reduces NOx; and a step of decreasing a flow rate of the exhaust gas sent to said NOx catalyst after it is determined by a determination means that said droplet-like reducing agent has spread in at least a predetermined range in said NOx catalyst.

* * * * *